US007615934B2

(12) United States Patent
Yang

(10) Patent No.: US 7,615,934 B2
(45) **Date of Patent: *Nov. 10, 2009**

(54) HIGH EFFICIENCY RESONANT BALLAST

(75) Inventor: Ta-yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 393 days.

This patent is subject to a terminal disclaimer.

(21) Appl. No.: 11/608,088

(22) Filed: Dec. 7, 2006

(65) Prior Publication Data

US 2008/0136346 A1 Jun. 12, 2008

(51) Int. Cl.
*H05B 37/02* (2006.01)

(52) U.S. Cl. ..... 315/224; 315/219; 315/309; 315/DIG. 5

(58) Field of Classification Search ..... 315/219, 315/224, 209 R, 221, 223, DIG. 5, DIG. 7
See application file for complete search history.

(56) References Cited

U.S. PATENT DOCUMENTS 7,084,580 B2 * 8/2006 Muramatsu et al. ..... 315/219
7,436,126 B2 * 10/2008 Yang ..... 315/224

* cited by examiner

*Primary Examiner*—David Hung Vu
(74) *Attorney, Agent, or Firm*—J.C. Patents

(57) ABSTRACT

The present invention provides a low-cost ballast circuit for fluorescent lamps. A resonant circuit has a transformer to operate the fluorescent lamp. The fluorescent lamp is connected in series with a first winding of the transformer. A first transistor and a second transistor are coupled to switch the resonant circuit. A second winding and a third winding of the transformer are used for generating control signals in response to a switching current of the resonant circuit. Furthermore, the present invention achieves soft operation for the first transistor and the second transistor.

18 Claims, 6 Drawing Sheets

HIGH EFFICIENCY RESONANT BALLAST

BACKGROUND OF THE INVENTION

1. Field of the Invention

The present invention generally relates to a switching circuit, and more particularly, to a ballast switching circuit.

2. Description of Related Art

Fluorescent lamps are the most popular light sources in our daily lives. To improve the efficiency of fluorescent lamps significantly saves energy. Therefore, in recent development, issues such as efficiency improvement and power saving for a ballast of the fluorescent lamp are deeply concerned. FIG. 1 shows a conventional electronic ballast circuit having a resonant circuit. A half-bridge inverter consists of two switches 10 and 15, which are complementarily switched on/off with 50% duty cycle at a desired switching frequency. The resonant circuit is composed of an inductor 75, a capacitor 70 to operate a fluorescent lamp 50. A capacitor 55 connected in parallel with the fluorescent lamp 50 operates as a start-up circuit. Once the fluorescent lamp 50 starts up, the switching frequency is controlled to produce a required lamp voltage. The drawback of this circuit is high switching loss on switches 10 and 15. The parasitic devices of the fluorescent lamp, such as the equivalent capacitance, vary in response to the temperature variation and the age of the fluorescent lamp 50. Besides, the inductance of the inductor 75 and the capacitance of the capacitor 70 vary during the mass production.

An objective of the present invention is to provide a ballast circuit capable of automatically achieving soft switching operation for reducing the switching loss and improving the efficiency.

Another objective of the present invention is to develop a low-cost ballast circuit with high efficiency performance.

SUMMARY OF THE INVENTION

The present invention provides a ballast circuit for fluorescent lamps. A resonant circuit formed by a capacitor and a transformer is connected in parallel with the fluorescent lamp. A first transistor and a second transistor are coupled to the resonant circuit for switching the resonant circuit. The transformer having a first winding is connected in series with the fluorescent lamp. A second winding and a third winding of the transformer are used for generating control signals in response to a switching current of the resonant circuit.

The first transistor is turned on once the first control signal is higher than a first threshold. After a quarter resonant period of the resonant circuit, the first transistor is turned off once the first control signal is lower than a second threshold. The second transistor is turned on once the second control signal is higher than the first threshold. After a quarter resonant period of the resonant circuit, the second transistor is turned off once the second control signal is lower than the second threshold. Therefore, a soft switching operation is achieved for the first transistor and the second transistor.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention.

FIG. 3~FIG. 6 respectively show four operation phases of the ballast circuit according to an embodiment of the present invention.

Figure 7:
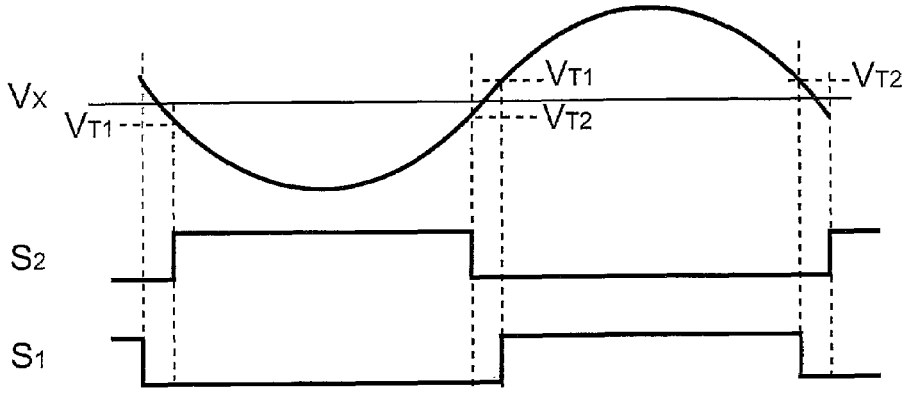

FIG. 7 shows the signal waveforms of the ballast circuit according to an embodiment of the present invention.

Figure 8:
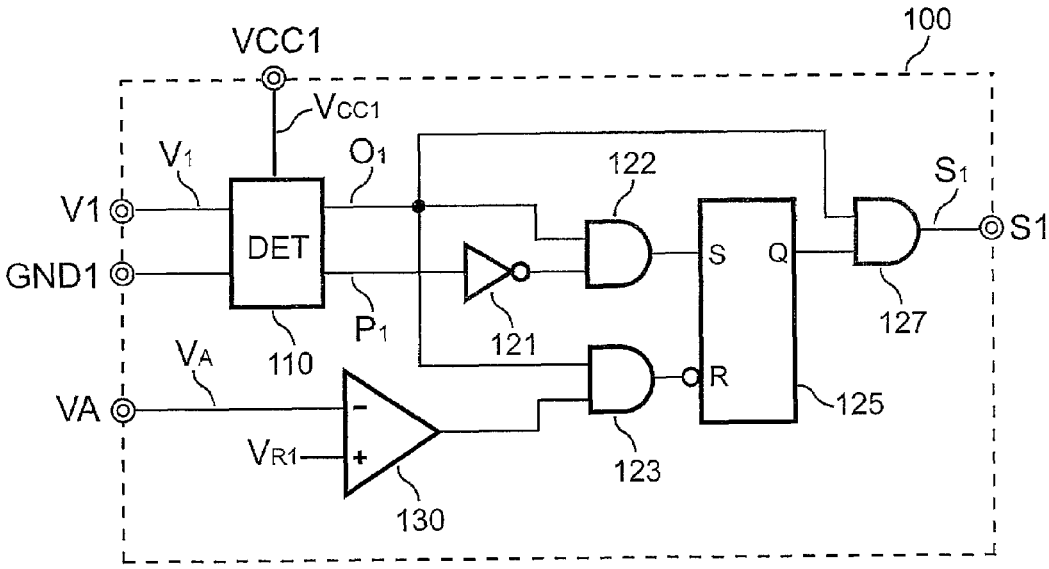

FIG. 8 shows a first control circuit according to an embodiment of the present invention.

Figure 9:
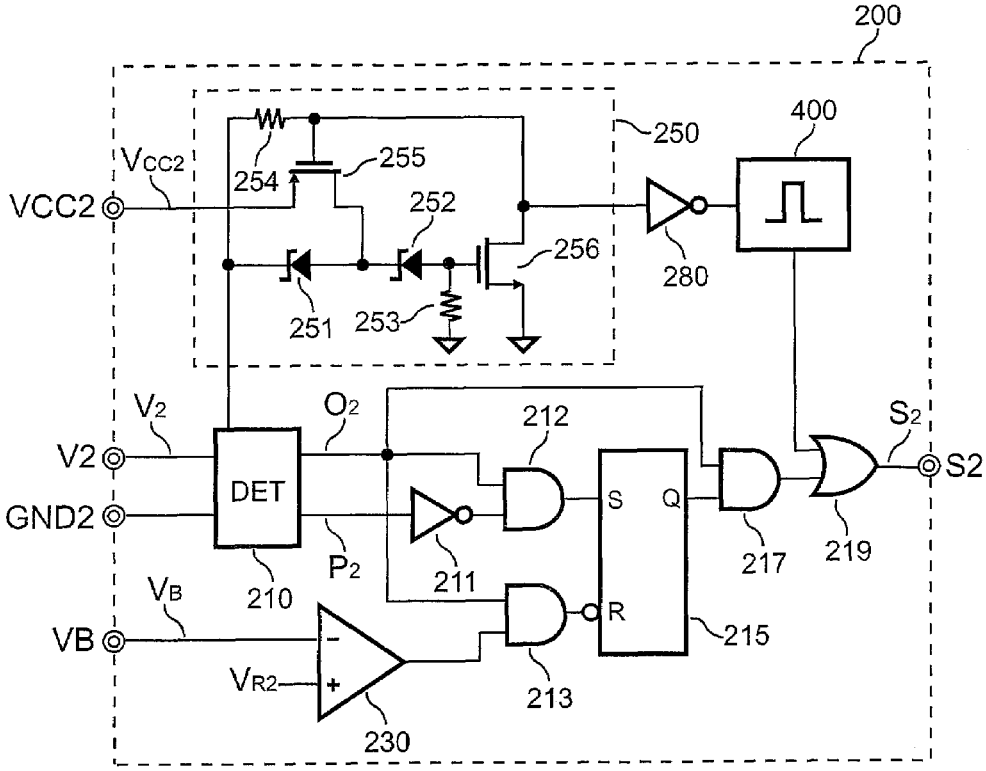

FIG. 9 shows a second control circuit according to the embodiment of the present invention.

Figure 10:
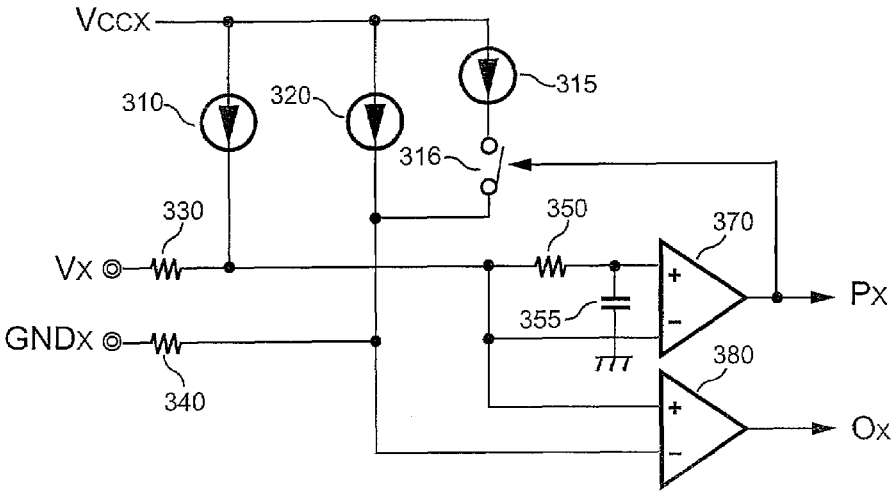

FIG. 10 shows a detection circuit according to an embodiment of the present invention.

Figure 11:
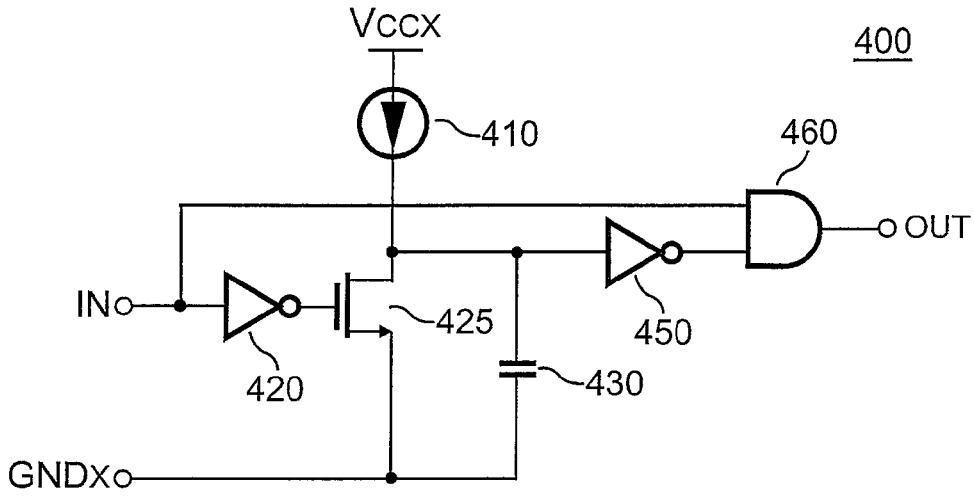

FIG. 11 shows a one-shot circuit according to an embodiment of the present invention.

Figure 12:
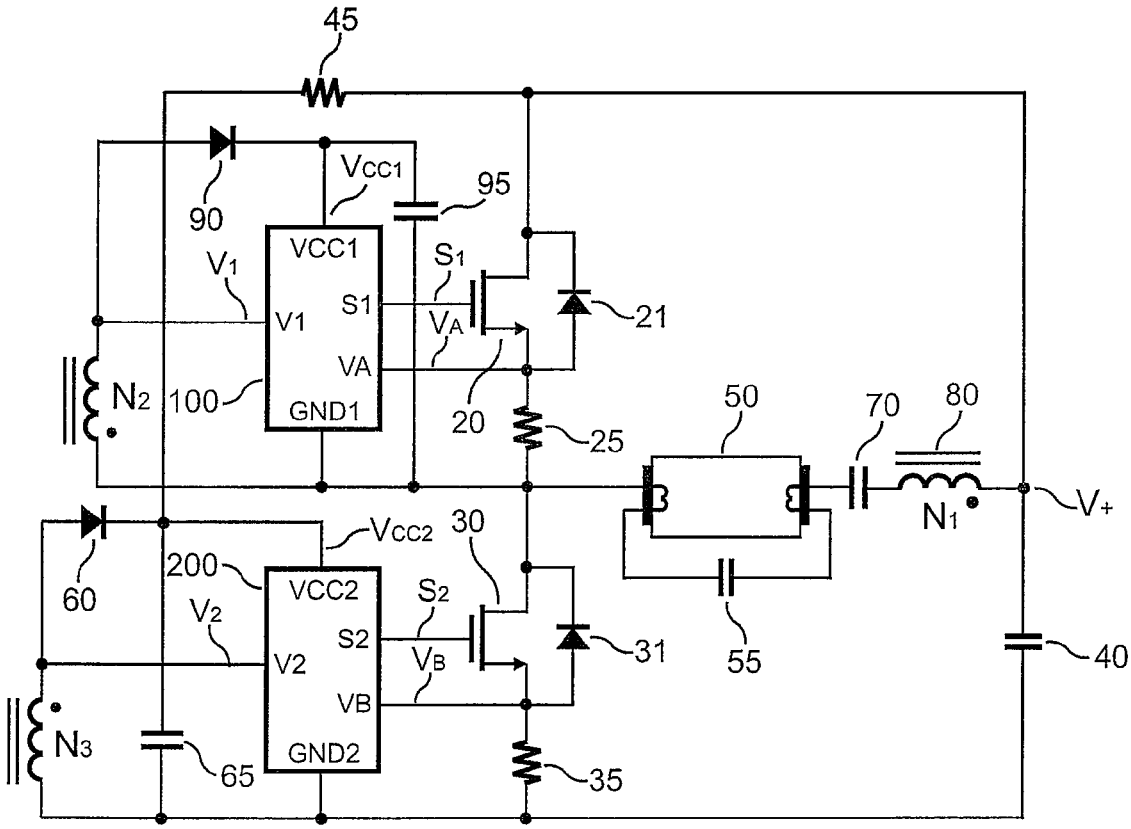

FIG. 12 shows a ballast circuit according to another embodiment of the present invention.

DESCRIPTION OF THE PREFERRED EMBODIMENT

Figure 1:
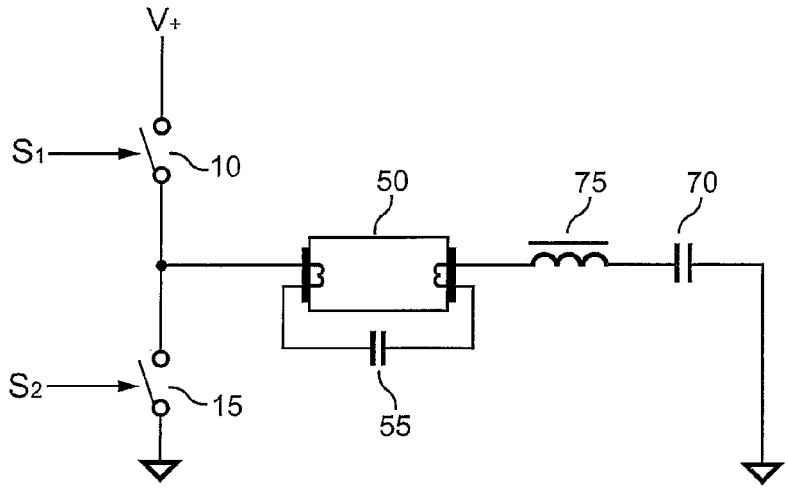
FIG. 1 (Prior Art)
FIG. 1 shows a conventional electronic ballast circuit.
Figure 2:
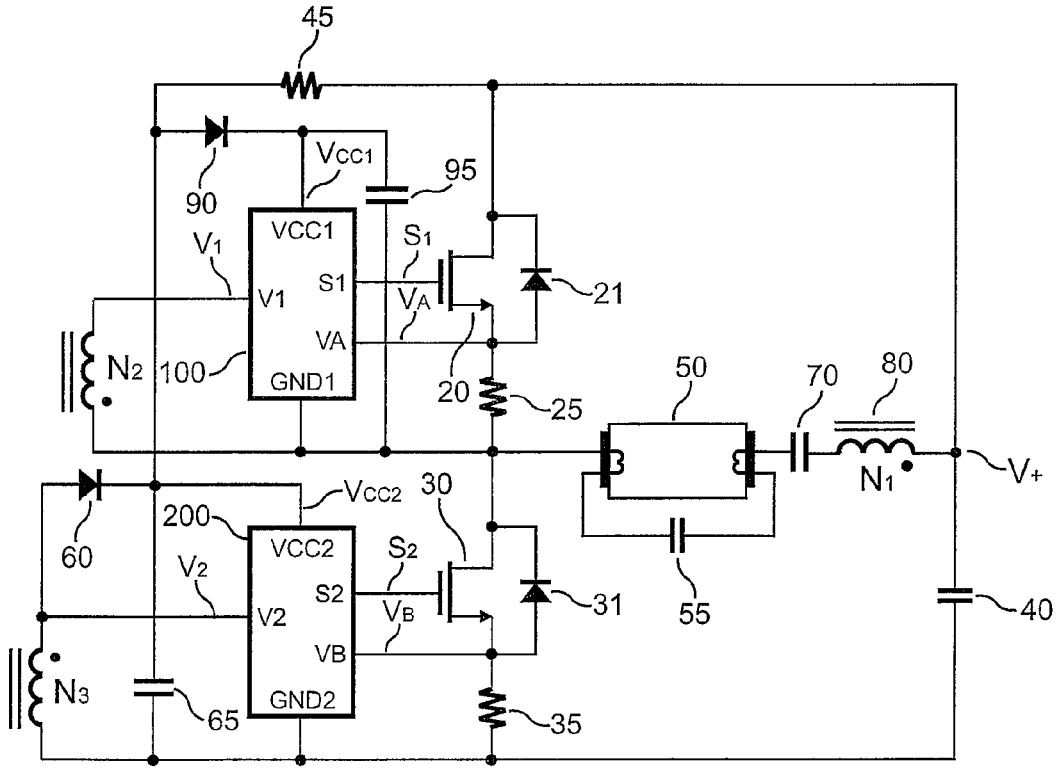
FIG. 2 shows a ballast circuit according to an embodiment of the present invention.
Figure 3:
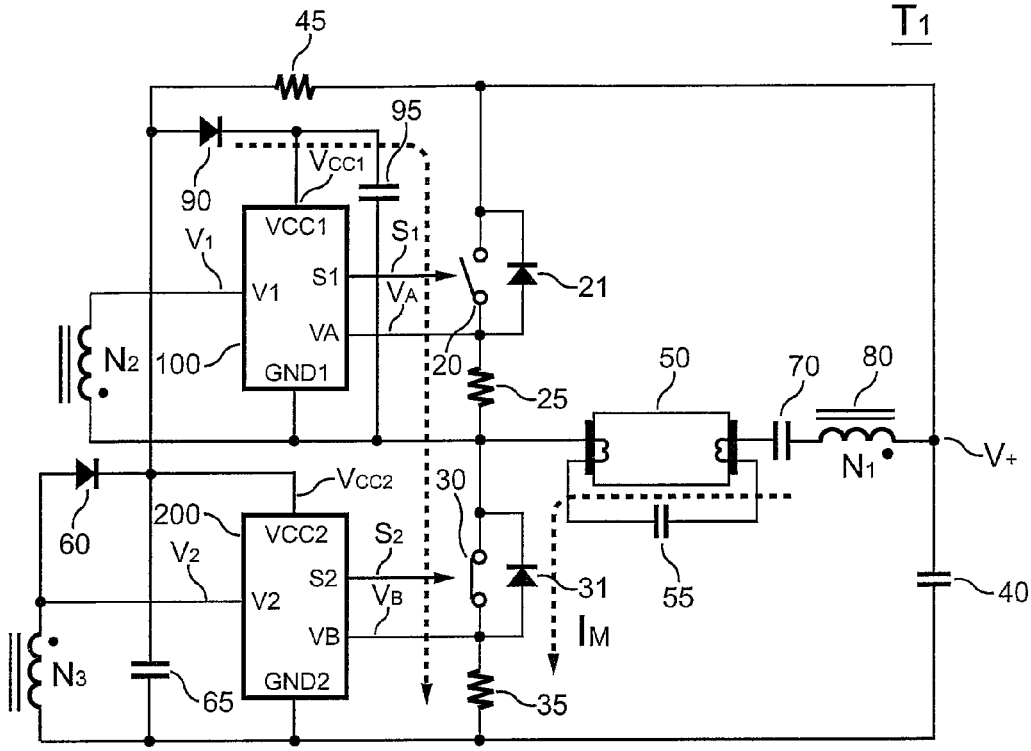
Figure 4:
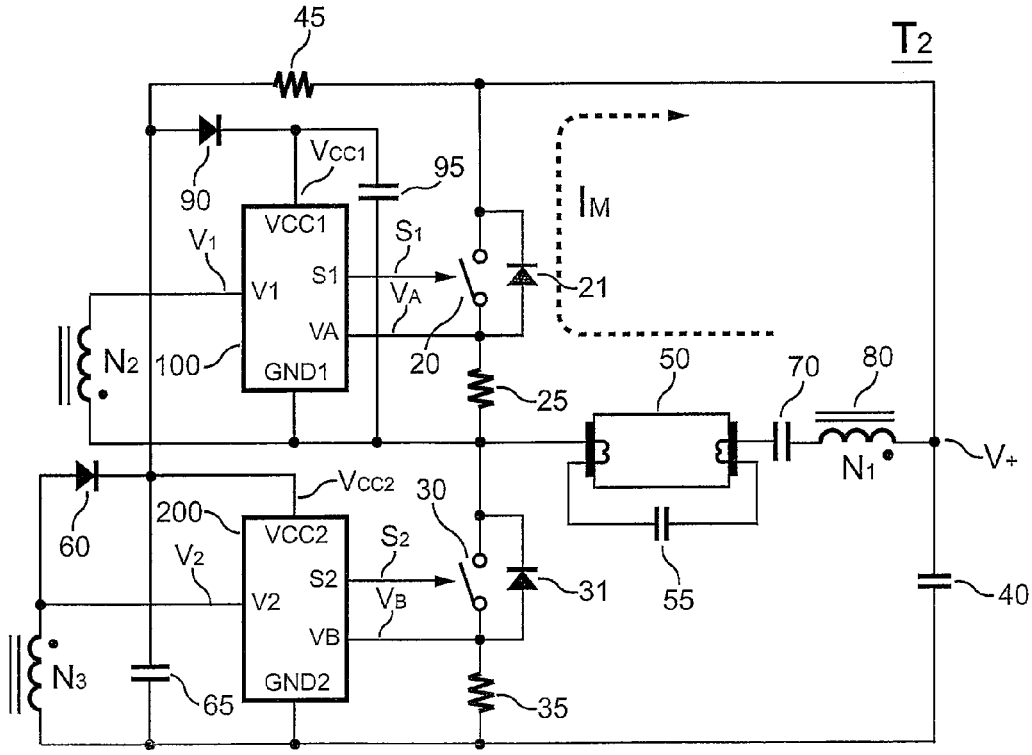
Figure 5:
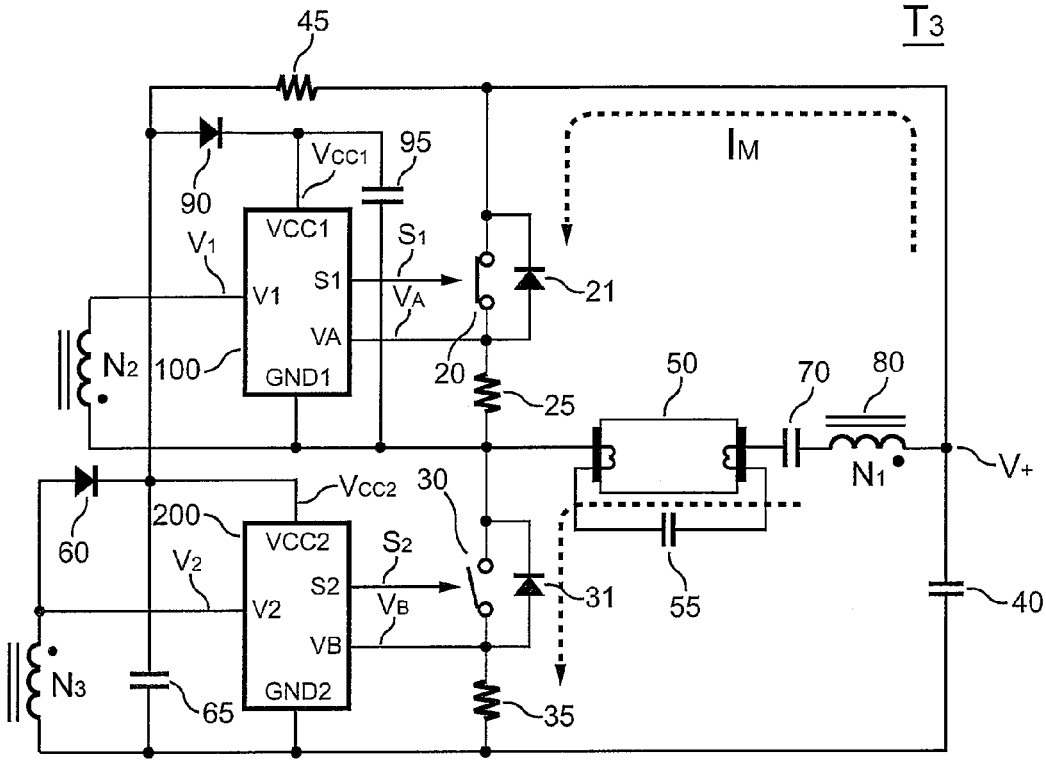
Figure 6:
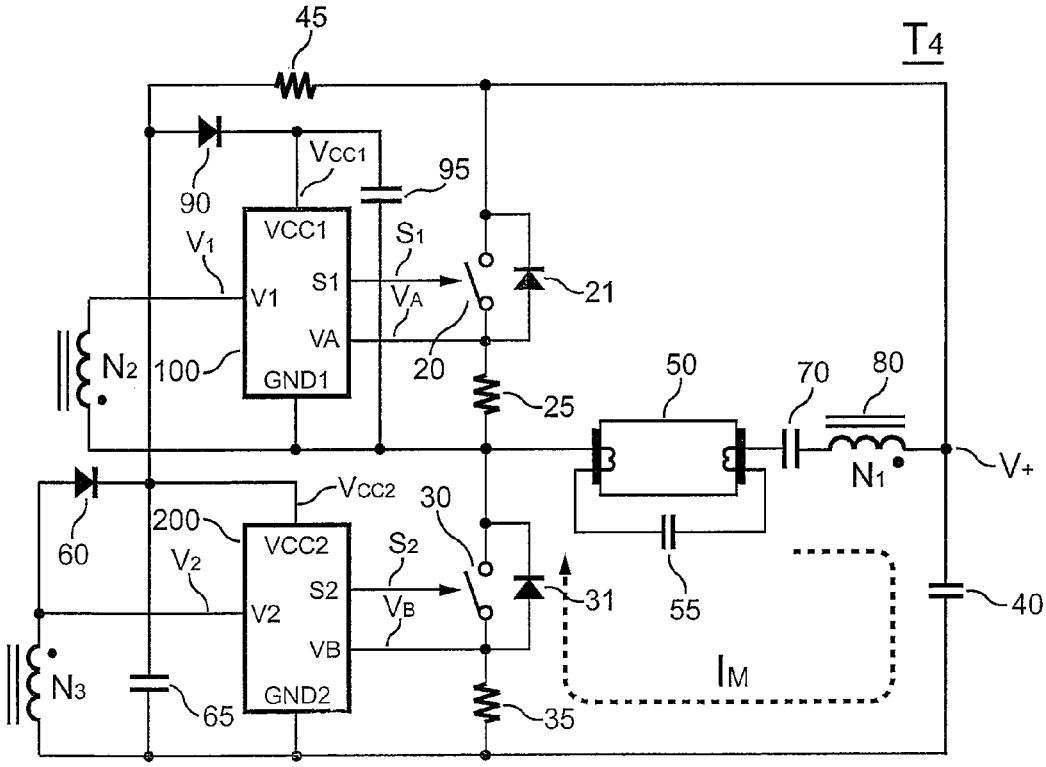

FIG. 2 shows a ballast circuit according to an embodiment of the present invention. A capacitor 70 and a transformer 80 are connected in series to form a resonant circuit for operating a fluorescent lamp 50. The resonant circuit produces a sine-wave current to drive the fluorescent lamp 50. A first transistor 20 is coupled to switch the resonant circuit. A first resistor 25 is connected in series with the first transistor 20 to detect a switching current for generating a first current signal $V_A$. The first transistor 20 is controlled by a first switching signal $S_1$. A second transistor 30 is coupled to the resonant circuit to supply an input voltage V+ to the resonant circuit. A second resistor 35 is connected in series with the second transistor 30 to detect the switching current for generating a second current signal $V_B$. The second transistor 30 is controlled by a second switching signal $S_2$. A first winding $N_1$ of the transformer 80 is connected in series with the fluorescent lamp 50.

A second winding $N_2$ and a third winding $N_3$ of the transformer 80 are used for generating a first control signal $V_1$ and a second control signal $V_2$ in response to the switching current of the resonant circuit. A first diode 21 is connected in parallel with the first transistor 20. A second diode 31 is connected in parallel with the second transistor 30. A first control circuit 100 generates the first switching signal $S_1$ for turning on/off the first transistor 20 in response to the first control signal $V_1$. A second control circuit 200 generates the second switching signal $S_2$ for controlling the second transistor 30 in response to the second control signal $V_2$. A third resistor 45 is coupled from the input voltage V+, which is supplied from a capacitor 40, to a capacitor 65 to charge the capacitor 65 once the power is applied to the ballast circuit. The capacitor 65 is further connected to the second control circuit 200 to provide a second supply voltage $V_{CC2}$. When a voltage across the capacitor 65 is higher than a start-up threshold, the second control circuit 200 will start to operate. A fourth diode 60 is coupled from the third winding $N_3$ of the transformer 80 to the capacitor 65 to further power the control circuits for switching the resonant circuit. A third diode 90 and a capacitor 95 form a charge pump circuit to provide a first supply voltage $V_{CC1}$ to the first control circuit 100. The third diode 90 is connected from the capacitor 65 to the capacitor 95. The capacitor 95 is connected to the first control circuit 100.

FIG. 3~FIG. 6 respectively show four operation phases of the switching circuit. When the second transistor 30 is turned on (the first operation phase $T_1$), a lamp current $I_M$ will flow via the transformer 80 to generate the second control voltage $V_2$. Meanwhile, the capacitor 95 is charged by the capacitor 65 via the third diode 90 and the second transistor 30. Once the lamp current $I_M$ decreases and the second control voltage $V_2$ is lower than a second threshold $V_{T2}$, the second transistor 30 will be turned off. After that, a circular current of the resonant circuit will turn on the first diode 21. The circular current is produced by the energy stored in the transformer 80. The energy of the resonant circuit will be circulated (the second operation phase $T_2$). The lamp current $I_M$ flowing via the transformer 80 generates the first control signal $V_1$. If the first control signal $V_1$ is higher than a first threshold $V_{T1}$, the first control circuit 100 will enable the first switching signal $S_1$ to turn on the first transistor 20. Since the first transistor 20 is turned on at the moment that the first diode 21 is being conducted, a soft switching operation for the first transistor 20 is achieved (the third operation phase $T_3$). When the lamp current $I_M$ decreases and the first control voltage $V_1$ is lower than a second threshold $V_{T2}$, the first transistor 20 will be turned off. Meanwhile, the circular current of the resonant circuit will turn on the second diode 31, and the energy of the resonant circuit will backward charge the capacitor 40 (the fourth operation phase $T_4$). Therefore, the second transistor 30 is turned on at the moment that the second diode 31 is being conducted. This also achieves a soft switching operation for the second transistor 30.

FIG. 7 shows the waveform in four operation phases, in which $V_X$ represents the first control signal $V_1$ or the second control signal $V_2$. The first switching signal $S_1$ is enabled once the first control signal $V_1$ is higher than the first threshold $V_{T1}$. After a quarter resonant period of the resonant circuit, the first switching signal $S_1$ is disabled once the first control signal $V_1$ is lower than the second threshold $V_{T2}$. A resonant frequency $f_R$ of the resonant circuit is given by, $$f_R = \frac{1}{2\pi\sqrt{LC}} \tag{1}$$

where L is the inductance of the first winding $N_1$ of the transformer 80; C is the equivalent capacitance of the fluorescent lamp 50 and the capacitor 70.

The second switching signal $S_2$ is enabled once the second control signal $V_2$ is higher than the first threshold $V_{T1}$. Also, after a quarter resonant period of the resonant circuit, the second switching signal $S_2$ is disabled once the second control signal $V_2$ is lower than the second threshold $V_{T2}$.

FIG. 8 shows the first control circuit 100 according to an embodiment of the present invention. A first detection circuit 110 is coupled to the second winding $N_2$ of the transformer 80 to detect the first control signal $V_1$ for generating a first enable signal $O_1$ and a first phase signal $P_1$. The first enable signal $O_1$ is enabled once the first control signal $V_1$ is higher than the first threshold $V_{T1}$. Detecting the waveform of the first control signal $V_1$ produces the first phase signal $P_1$ to indicate a quarter resonant period of the resonant circuit. A first comparator 130 is coupled to detect the first current signal $V_A$ for producing a first reset signal. The first reset signal is generated once the switching current is higher than a first over-current threshold $V_{R1}$. The first enable signal $O_1$ is supplied to an input of an AND gate 122 and an input of an AND gate 123. The first phase signal $P_1$ is supplied to another input of the AND gage 122 via an inverter 121. An output of the first comparator 130 is connected to another input of the AND gate 123. An output of the AND gate 122 is connected to a set-input of a flip-flop 125. An output of the AND gate 123 is connected to a reset-input of the flip-flop 125. An output of the flip-flop 125 is connected to an input of an AND gate 127. Another input of the AND gate 127 is supplied with the first enable signal $O_1$. The output of the AND gate 127 generates the first switching signal $S_1$. Therefore, the first switching signal $S_1$ is generated in response to the first enable signal $O_1$, the first phase signal $P_1$ and the first reset signal.

FIG. 9 shows the second control circuit 200 according to an embodiment of the present invention. A second detection circuit 210 is coupled to the third winding $N_3$ of the transformer 80 to detect the second control signal $V_2$ for generating a second enable signal $O_2$ and a second phase signal $P_2$. The second enable signal $O_2$ is enabled once the first control signal $V_1$ is higher than the first threshold $V_{T1}$. Detecting the waveform of the second control signal $V_2$ produces the second phase signal $P_2$ to indicate a quarter resonant period of the resonant circuit. A second comparator 230 is coupled to detect the second current signal $V_B$ for producing a second reset signal. The second reset signal is generated once the switching current is higher than a second over-current threshold $V_{R2}$. The second enable signal $O_2$ is supplied to an input of an AND gate 212 and an input of an AND gate 213. The second phase signal $P_2$ is supplied to another input of the AND gate 212 via an inverter 211. An output of the comparator 230 is connected to another input of the AND gate 213. An output of the AND gate 212 is connected to a set-input of a flip-flop 215. An output of the AND gate 213 is connected to a reset-input of the flip-flop 215. An output of the flip-flop 215 is connected to an input of an AND gate 217. Another input of the AND gate 217 is supplied with the second enable signal $O_2$.

An output of the AND gate 217 is further connected to an OR gate 219. Another input of the OR 219 is coupled to an output of a one-shot circuit 400 to receive a one-shot signal. An output of the OR gate 219 generates the second switching signal $S_2$. An input of the one-shot circuit 400 receives a start-up signal via an inverter 280. Two zener diodes 251, 252, two transistors 255, 256 and two resistors 253, 254 develop a start-up circuit 250 to generate the start-up signal in response to the second supply voltage $V_{CC2}$. The zener diodes 251 and 252 determine a start-up threshold. The start-up circuit enables (logic-low) the start-up signal when the second supply voltage $V_{CC2}$ is higher than the start-up threshold. In the mean time, the logic-low start-up signal will turn on the transistor 255 to short circuit the zener diode 251 and produce a turn-off threshold. The turn-off threshold is determined by the zener diode 252. Therefore, the start-up signal is disabled (logic-high) once the second supply voltage $V_{CC2}$ is lower than the turn-off threshold. The first switching signal $S_1$ is therefore generated in response to the one-shot signal, the second enable signal $O_2$, the second phase signal $P_2$ and the second reset signal.

FIG. 10 shows the circuit schematic of the detection circuits 110 and 210. A control signal $V_X$ represents the first control signal $V_1$ or the second control signal $V_2$. A first input resistor 330 and a second input resistor 340 are coupled to the transformer 80 for receiving the control signal $V_X$ ($V_1$ or $V_2$). A first current source 310 and a second current source 320 are coupled to the first input resistor 330 and the second input resistor 340 respectively. Input resistors 330, 340 and current sources 310, 320 provide level shifting to detect the signal waveform of the control signal $V_X$. The resistance of input resistors 330 and 340 are equal. The current of the second current source 320 is higher than that of the first current source 310. Therefore the voltage generated at the second input resistor 340 is higher than the voltage generated at the first input resistor 330.

A differential voltage in between the first input resistor 330 and the second input resistor 340 determines the first threshold $V_{T1}$. A third current source 315 is coupled to the second input resistor 340 via a control switch 316. A comparator 370 has an input coupled to the first input resistor 330. Another input of the comparator 370 is connected the first input resistor 330 via a delay circuit. The delay circuit is formed by a resistor 350 and a capacitor 355. An output of the comparator 370 generates a phase signal $P_X$, which represents the first phase signal $P_1$ or the second phase signal $P_2$. The phase signal $P_X$ is further utilized to turn on/off the control switch 316. When the magnitude of the control signal $V_X$ is going down, the comparator 370 will output a logic-high signal to turn on the switch 316 and connect the third current source 315 and the second input resistor 340. Therefore, the second current source 320 associates with the third current source 315 to generate a higher voltage at the second input resistor 340, which determines the second threshold $V_{T2}$. Therefore, the second threshold $V_{T2}$ is higher than the first threshold $V_{T1}$.

A comparator 380 has an input coupled to the first input resistor 330. Another input of the comparator 380 is connected to the second input resistor 340. The enable signals $O_X$ representing the first enable signal $O_1$ or the second enable signal $O_2$ is generated at an output of the comparator 380. FIG. 11 shows the one-shot circuit 400 according to an embodiment of the present invention. A current source 410 and a capacitor 430 determine an enable period of the one-shot signal.

FIG. 12 shows a ballast circuit according to another embodiment of the present invention. Since the first transistor 20 and the second transistor 30 are turned off before the energy of the resonant circuit is fully discharged, the energy is able to generate the circular current to turn on the diodes 21 and 31. Besides, the switching operation of transistors 20 and 30 can be detected by the polarity change from control signals $V_1$ and $V_2$. The transistor can be turned on immediately after the diode is conducted. Therefore, the present invention achieves soft switching operation and improves the efficiency of the ballast circuit.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A switching circuit for a ballast, comprising:

a resonant circuit, having a capacitor and a transformer connected in series to operate a lamp; wherein said transformer has a first winding connected in series with said lamp; a second winding and a third winding of said transformer generate a first control signal and a second control signal in response to a switching current of said resonant circuit;

a first transistor, coupled to switch said resonant circuit in response to a first switching signal;

a second transistor, coupled to switch said resonant circuit in response to a second switching signal;

a first control circuit, coupled to generate said first switching signal in response to said first control signal;

a second control circuit, coupled to generate said second switching signal in response to said second control signal; and a charge pump circuit, coupled to said first control circuit to provide a first supply voltage to said first control circuit; wherein said third winding of said transformer is coupled to provide a second supply voltage to said second control circuit; wherein said charge pump circuit is further coupled to said second control circuit.

2. The switching circuit as claimed in claim 1, wherein said first switching signal is enabled once said first control signal is higher than a first threshold; after a quarter resonant period of said resonant circuit, said first switching signal is disabled once said first control signal is lower than a second threshold; wherein said second switching signal is enabled once said second control signal is higher than said first threshold; after a quarter resonant period of said resonant circuit, said second switching signal is disabled once said second control signal is lower than said second threshold.

3. The switching circuit as claimed in claim 1, wherein said first control circuit comprises:

a first detection circuit, coupled to said second winding of said transformer to detect said first control signal for generating a first enable signal and a first phase signal; wherein said first enable signal is enabled once said first control signal is higher than a first threshold; said first phase signal is produced by detecting the waveform of said first control signal to indicate a quarter resonant period of said resonant circuit; and a first comparator, coupled to detect said switching current for producing a first reset signal; said first reset signal being generated once said switching current being higher than a first over-current threshold; wherein said first switching signal is generated in response to said first enable signal, said first phase signal and said first reset signal.

4. The switching circuit as claimed in claim 1, wherein said second control circuit comprises:

a second detection circuit, coupled to said third winding of said transformer to detect said second control signal for generating a second enable signal and a second phase signal; wherein said second enable signal is enabled once said second control signal is higher than a first threshold; said second phase signal is produced by detecting the waveform of said second control signal to indicate a quarter resonant period of said resonant circuit;

a second comparator, coupled to detect said switching current for producing a second reset signal; said second reset signal being generated once said switching current being higher than a second over-current threshold;

a start-up circuit, to generate a start-up signal when said second supply voltage being higher than a start-up threshold; and an one-shot circuit, to generate an one-shot signal in response to said start-up signal; wherein said second switching signal is generated in response to said one-shot signal, said second enable signal, said second phase signal and said second reset signal.

5. The switching circuit as claimed in claim 3, wherein said first detection circuit comprises:

a first input resistor and a second input resistor, coupled to said transformer;

a first current source and a second current source, respectively coupled to said first input resistor and said second input resistor;

a third current source, coupled to said second input resistor via a first control switch; said first control switch being turned on/off by said first phase signal;

a third comparator, for generating said first phase signal; wherein said third comparator has an input coupled to said first input resistor; another input of said third comparator is connected to said first input resistor via a first delay circuit; and a fourth comparator, for generating said first enable signal; wherein said fourth comparator has an input coupled to said first input resistor; another input of said fourth comparator is connected to said second input resistor.

6. The switching circuit as claimed in claim 4, wherein said second detection circuit comprises:

a third input resistor and a fourth input resistor, coupled to said transformer;

a fourth current source and a fifth current source, respectively coupled to said third input resistor and said fourth input resistor;

a sixth current source, coupled to said fourth input resistor via a second control switch; said second control switch being turned on/off by said second phase signal;

a fifth comparator, for generating said second phase signal; wherein said fifth comparator has an input coupled to said third input resistor; another input of said fifth comparator is connected to said third input resistor via a second delay circuit; and a sixth comparator, for generating said second enable signal; wherein said sixth comparator has an input coupled to said third input resistor; another input of said sixth comparator is connected to said fourth input resistor.

7. A ballast circuit, comprising:

a resonant circuit, having a capacitor and a transformer connected in series to operate a lamp; wherein said transformer generates a first control signal and a second control signal in response to a switching of said resonant circuit;

a first transistor, coupled to switch said resonant circuit in response to a first switching signal;

a second transistor, coupled to switch said resonant circuit in response to a second switching signal;

a first control circuit, coupled to generate said first switching signal in response to said first control signal;

a second control circuit, coupled to generate said second switching signal in response to said second control signal; and a charge pump circuit, coupled to generate a supply voltage for said resonant circuit.

8. The ballast circuit as claimed in claim 7, wherein said first switching signal is enabled once said first control signal is higher than a first threshold; after a quarter resonant period of said resonant circuit, said first switching signal is disabled once said first control signal is lower than a second threshold; wherein said second switching signal is enabled once said second control signal is higher than said first threshold; after a quarter resonant period of said resonant circuit, said second switching signal is disabled once said second control signal is lower than said second threshold.

9. The ballast circuit as claimed in claim 7, wherein said first control circuit comprises:

a first detection circuit, coupled to said transformer to detect said first control signal for generating a first enable signal and a first phase signal; wherein said first enable signal is enabled once said first control signal is higher than a first threshold; said first phase signal is generated in response to the waveform of said first control signal; wherein said first switching signal is generated in response to said first enable signal and said first phase signal.

10. The ballast circuit as claimed in claim 7, wherein said second control circuit comprises:

a second detection circuit, coupled to said transformer to detect said second control signal for generating a second enable signal and a second phase signal; wherein said second enable signal is enabled once said second control signal is higher than a first threshold; said second phase signal is generated in response to the waveform of said second control signal; wherein said second switching signal is generated in-response to said second enable signal and said second phase signal.

11. The ballast circuit as claimed in claim 9, wherein said first detection circuit comprises:

a first input resistor and a second input resistor, coupled to said transformer;

a first current source and a second current source, respectively coupled to said first input resistor and said second input resistor;

a third current source, coupled to said second input resistor via a first control switch; said first control switch being turned on/off by said first phase signal;

a third comparator, for generating said first phase signal; wherein said third comparator has an input coupled to said first input resistor; another input of said third comparator is connected to said first input resistor via a first delay circuit; and a fourth comparator, for generating said first enable signal; wherein said fourth comparator has an input coupled to said first input resistor; another input of said fourth comparator is connected to said second input resistor.

12. The ballast circuit as claimed in claim 10, wherein said second detection circuit comprises:

a third input resistor and a fourth input resistor, coupled to said transformer;

a fourth current source and a fifth current source, respectively coupled to said third input resistor and said fourth input resistor;

a sixth current source, coupled to said fourth input resistor via a second control switch; said second control switch being turned on/off by said second phase signal;

a fifth comparator, for generating said second phase signal; wherein said fifth comparator has an input coupled to said third input resistor; another input of said fifth comparator is connected to said third input resistor via a second delay circuit; and a sixth comparator, for generating said second enable signal; wherein said sixth comparator has an input coupled to said third input resistor; another input of said sixth comparator is connected to said fourth input resistor.

13. A switching circuit, comprising:

a resonant circuit, having a transformer connected in series with a lamp to operate said lamp; wherein said transformer generates a first control signal and a second control signal in response to a switching current of said resonant circuit;

a first transistor, coupled to switch said resonant circuit in response to a first switching signal;

a second transistor, coupled to switch said resonant circuit in response to a second switching signal;

a first control circuit, coupled to generate said first switching signal in response to said first control signal; and a second control circuit, coupled to generate said second switching signal in response to said second control signal; wherein said transformer is coupled to provide a supply voltage for said resonant circuit.

14. The switching circuit as claimed in claim 13, wherein said first switching signal is enabled once said first control signal is higher than a first threshold; after a quarter resonant period of said resonant circuit, said first switching signal is disabled once said first control signal is lower than a second threshold; wherein said second switching signal is enabled once said second control signal is higher than said first threshold; after a quarter resonant period of said resonant circuit, said second switching signal is disabled once said second control signal is lower than said second threshold.

15. The switching circuit as claimed in claim 13, wherein said first control circuit comprises:

a first detection circuit, coupled to a second winding of said transformer to detect said first control signal for generating a first enable signal and a first phase signal; wherein said first enable signal is enabled once said first control signal is higher than a first threshold; said first phase signal is generated in response to the waveform of said first control signal; and a first comparator, coupled to detect said switching current for producing a first reset signal; said first reset signal being generated once said switching current being higher than a first over-current threshold; wherein said first switching signal is generated in response to said first enable signal, said first phase signal and said first reset signal.

16. The switching circuit as claimed in claim 13, wherein said second control circuit comprises:

a second detection circuit, coupled to a third winding of said transformer to detect said second control signal for generating a second enable signal and a second phase signal; wherein said second enable signal is enabled once said second control signal is higher than a first threshold; said second phase signal is generated in response to the waveform of said second control signal;

a second comparator, coupled to detect said switching current for producing a second reset signal; said second reset signal being generated once said switching current being higher than a second over-current threshold;

a start-up circuit, to generate a start-up signal when said supply voltage being higher than a start-up threshold; and an one-shot circuit, to generate an one-shot signal in response to said start-up signal; wherein said second switching signal is generated in response to said one-shot signal, said second enable signal, said second phase signal and said second reset signal.

17. The switching circuit as claimed in claim 15, wherein said first detection circuit comprises:

a first input resistor and a second input resistor, coupled to said transformer;

a first current source and a second current source, respectively coupled to said first input resistor and said second input resistor;

a third current source, coupled to said second input resistor via a first control switch; said first control switch being turned on/off by said first phase signal;

a third comparator, for generating said first phase signal; wherein said third comparator has an input coupled to said first input resistor; another input of said third comparator is connected to said first input resistor via a first delay circuit; and a fourth comparator, for generating said first enable signal; wherein said fourth comparator has an input coupled to said first input resistor; another input of said fourth comparator is connected to said second input resistor.

18. The switching circuit as claimed in claim 16, wherein said second detection circuit comprises:

a third input resistor and a fourth input resistor, coupled to said transformer;

a fourth current source and a fifth current source, respectively coupled to said third input resistor and said fourth input resistor;

a sixth current source, coupled to said fourth input resistor via a second control switch; said second control switch being turned on/off by said second phase signal;

a fifth comparator, for generating said second phase signal; wherein said fifth comparator has an input coupled to said third input resistor; another input of said fifth comparator is connected to said third input resistor via a second delay circuit; and a sixth comparator, for generating said second enable signal; wherein said sixth comparator has an input coupled to said third input resistor; another input of said sixth comparator is connected to said fourth input resistor.

* * * * *